US007140929B2

(12) United States Patent
Yamada

(10) Patent No.: US 7,140,929 B2
(45) **Date of Patent: *Nov. 28, 2006**

(54) ELECTRONIC CONNECTOR TERMINAL, A METHOD FOR PLATING, AND A TERMINAL STACK

(75) Inventor: Shoji Yamada, Tokyo (JP)

(73) Assignee: Quasar System, Inc., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/167,518

(22) Filed: Jun. 27, 2005

(65) Prior Publication Data

US 2005/0233653 A1 Oct. 20, 2005

Related U.S. Application Data

(63) Continuation-in-part of application No. 10/796,624, filed on Mar. 9, 2004, now Pat. No. 6,910,926.

(51) Int. Cl.
*H01R 13/02* (2006.01)

(52) U.S. Cl. ..... 439/886

(58) Field of Classification Search ..... 439/886, 439/427, 857, 856, 874, 687, 668
See application file for complete search history.

(56) References Cited

U.S. PATENT DOCUMENTS 2,221,616 A * 11/1940 Smith ..... 257/658
2,482,817 A * 9/1949 Vitrogan ..... 257/42
2,857,446 A * 10/1958 Imelmann ..... 136/211
3,094,438 A * 6/1963 Daley et al. ..... 429/161
5,011,256 A 4/1991 Johnson et al.
5,173,766 A 12/1992 Long et al.
5,760,339 A * 6/1998 Faulkner et al. ..... 174/88 B
6,488,550 B1 12/2002 Kikuchi et al.
6,508,656 B1 * 1/2003 Chevassus-More et al. . 439/212
6,679,709 B1 1/2004 Takeuchi
6,789,308 B1 9/2004 Takaba et al.
6,790,047 B1 9/2004 Togashi
6,910,926 B1 * 6/2005 Yamada ..... 439/886

FOREIGN PATENT DOCUMENTS

| | | |
|---|---|---|
| JP | 49-114796 | 11/1974 |
| JP | 10-172684 | 6/1998 |
| JP | 10-334974 | 12/1998 |
| JP | 11-097093 | 4/1999 |
| JP | 11-193494 | 7/1999 |
| JP | 11-214115 | 8/1999 |

* cited by examiner

*Primary Examiner*—Tulsidas C. Patel
*Assistant Examiner*—Phuongchi Nguyen
(74) *Attorney, Agent, or Firm*—Malloy & Malloy, P.A.

(57) ABSTRACT

An electronic connector terminal and its method of formation comprising a terminal base material 2 formed from a thin metal plate including and a high cost metal plating layer 17, which covers the terminal base material 2. The terminal base material 2 is preferably formed by punching from the thin plate and includes an outer peripheral edge or lateral part 4 having at least one contact 6, and planer parts 5 defined by front and back surfaces of the punched-out piece. The high cost metal plating layer 17 on the planer parts 5 has a lesser thickness than the thickness of a high cost metal plating layer 17 on the lateral part 4.

11 Claims, 5 Drawing Sheets

(a)

(b)

ELECTRONIC CONNECTOR TERMINAL, A METHOD FOR PLATING, AND A TERMINAL STACK

CLAIM OF PRIORITY

The present application is a continuation-in-part application of previously filed application having Ser. No. 10/796,624, filed on Mar. 9, 2004 which matured into U.S. Pat. No. 6,910,926 on Jun. 28, 2005 and is incorporated herein in its entirety by reference.

BACKGROUND OF THE INVENTION

1. Field of the Invention

The present invention relates to an electronic connector terminal, and more particularly to an electronic connector terminal produced by punching a thin metal plate in a desired shape followed by plating with Au or other high cost metals.

2. Description of the Related Art

An electronic connector terminal is generally formed by punching a thin plate of electrically conductive material into a predetermined shape. Such an electronic connector terminal usually comprises planar parts defined by front and back faces of a punched out piece and peripheral or lateral parts formed by the punching of the thin plate. Generally the electronic connector terminal is categorized into two kinds of terminals; one is a terminal disposed such that the planar part of the thin plate includes a connection to a connector housing when inserted therein, and another is a terminal disposed such that the peripheral or lateral part includes a connection to the connector housing when inserted therein. The terminal, which is configured to have the connection point on the lateral part has advantages in that the terminal is easier to maintain a required contact pressure than the terminal configured to have a connection point on the lateral part and in which the terminal can be disposed in a narrow pitch.

Generally, an electronic connector terminal is applied with plating on predetermined surfaces of the terminal so as to prevent degradation of connecter performance due to oxidation during long usage thereby enhancing electrical conductivity. Conventionally, in the terminal configured to have the electronic connection on the lateral part, the electronic plating is provided on the entire surface of the terminal. Therefore, there is a disadvantage relating to the large amounts of gold (Au) or other high cost metals used for plating the required surfaces, thereby significantly increasing the product cost thereof.

With respect to the above noted disadvantages, the terminal with plating only on the connection point of the lateral part has been proposed. For example, a method comprising the following steps has been proposed in Japanese Patent (Laid-Open) No. Showa 49-114796 and the steps are:

stacking a plurality of connector terminals; and plating thereon such that unnecessary plating layers can not be deposited on planar parts of a fork-shaped spring.

The planar part may be oxidized during long term usage and the connector performance thereof may be degraded even though the planar part is not subjected to circumstances which cause oxidation as is the lateral part. With respect to this problem, a contact element having a planar part covered with an insulation film has been proposed in Japanese Utility Model (Laid-Open) No. Heisei 5-90834. This contact element is formed by masking the part on which the insulator film is not deposited, and thereafter, dipping the contact in a fluorine-system resin solution to form the insulation film thereon.

However, the above process requires a masking step in which the contact including the plating layer must be masked after the Au plating of the contact portion. This is followed by dipping in the fluorine-system resin solution thereby increasing product costs because additional production processes are required and process steps are increased resulting in an expenditure of time and effort as well as requiring masking materials and the fluorine-system resin solution.

The inventor herein has proposed, in U.S. patent application Ser. No. 10/796,624 filed on Mar. 9, 2004, an electric terminal having Au plating of different thickness in the major plane and the lateral plane.

Even in light of the above described techniques, there is still a significant need for an electronic terminal which is produced easily and inexpensively by reducing the amount of high cost metals necessary for plating without requiring additional production processes.

SUMMARY OF THE INVENTION

Regarding the above set forth problems, an object of the present invention is to provide an electronic connector terminal which is produced easily and inexpensively by reducing the amount of high cost metals needed for plating without requiring additional production processes, wherein the electronic connector terminal is able to maintain sufficient contact pressure even when the terminal width is narrowed.

Accordingly, an electronic connector terminal of the present invention comprises a terminal base material formed by punching a thin metal plate and providing a high cost metal plating layer which covers the terminal base material. The terminal base material further comprises a lateral part having at least one contact and substantially defined as a peripheral edge or surface of the thin plate formed through the punching and also comprising a planar part defined by front and back surfaces of the punched-out piece from the thin plate. Further, a thickness of the high cost metal plating layer covering the planar part is thinner than a thickness of a high cost metal plating layer covering the peripheral or lateral part, which has at least one contact.

In the present invention, a ratio of the thickness of the high cost metal plating layer covering the peripheral edge or lateral part and the thickness of the high cost metal plating layer covering the planar part is preferably from about 100:1 to 5:1. Further, the high cost metal is preferably selected from the group consisting of Pt, In, Pd, V, Ag, Ru, Sn, Co, Nb, Cr, Mo and Ni as well as any combination thereof.

In the present invention, the electronic connector terminal may also comprise a liner plating layer formed between the terminal base material and the high cost metal plating layer, wherein the liner plating layer covers the terminal base material. In the present invention, a thickness of a liner plating layer covering the planar part is thinner than a thickness of a liner plating layer covering the lateral part having the at least one contact.

In the present invention, a ratio of the thickness of the liner plating layer covering the lateral part and the thickness of the liner plating layer covering the planar part is to be from about 100:1 to 5:1.

According to another preferred embodiment of the present invention, a method for plating an electric connector terminal with a plating layer of a high cost metal may be provided. The method comprises the steps of:

suspending a stacked bank of terminals from at least one carrier bar, the stacked bank comprising a plurality of terminals stacked in juxtaposed, adjacent relation to each other, dipping the stacked bank in a plating solution comprising the high cost metal, and plating the terminal stacks by electric plating while moving the stack bank reciprocally or through a "round trip movement" in the plating solution at predetermined cycles and predetermined directions so as to deposit plating layers of different thickness on a lateral part and a planar part.

The present invention further includes the high cost metal being selected from the group consisting of Pt, In, Pd, V, Ag, Ru, Sn, Co, Nb, Cr, Mo, Au and Ni and any combination thereof.

In the present invention, the terminal stack comprises a plurality of terminal bases, and the round trip movement further comprises moving the carrier bar in predetermined reciprocal or round trip movements at predetermined cycles and in predetermined directions.

Further another preferred embodiment of the present invention comprises a terminal stack used for an electric plating. The terminal stack comprising:

a plurality of terminal bases;

a carrier connected to each of the terminal bases and extending in a longitudinal direction to retain the terminal bases, wherein a plurality of openings are provided through which carrier bars are inserted;

a tab including a slant plane with respect to a thickness of the carrier and being disposed at an end defining a longitudinal limit of the carrier.

In the present invention, a tab is disposed on one of the ends of the carrier or tabs are disposed at both ends thereof.

In the present invention, the tab has a cross section comprising the general configuration of a triangle or a trapezoid.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

EXPLANATION OF NUMERALS

Figure 1:
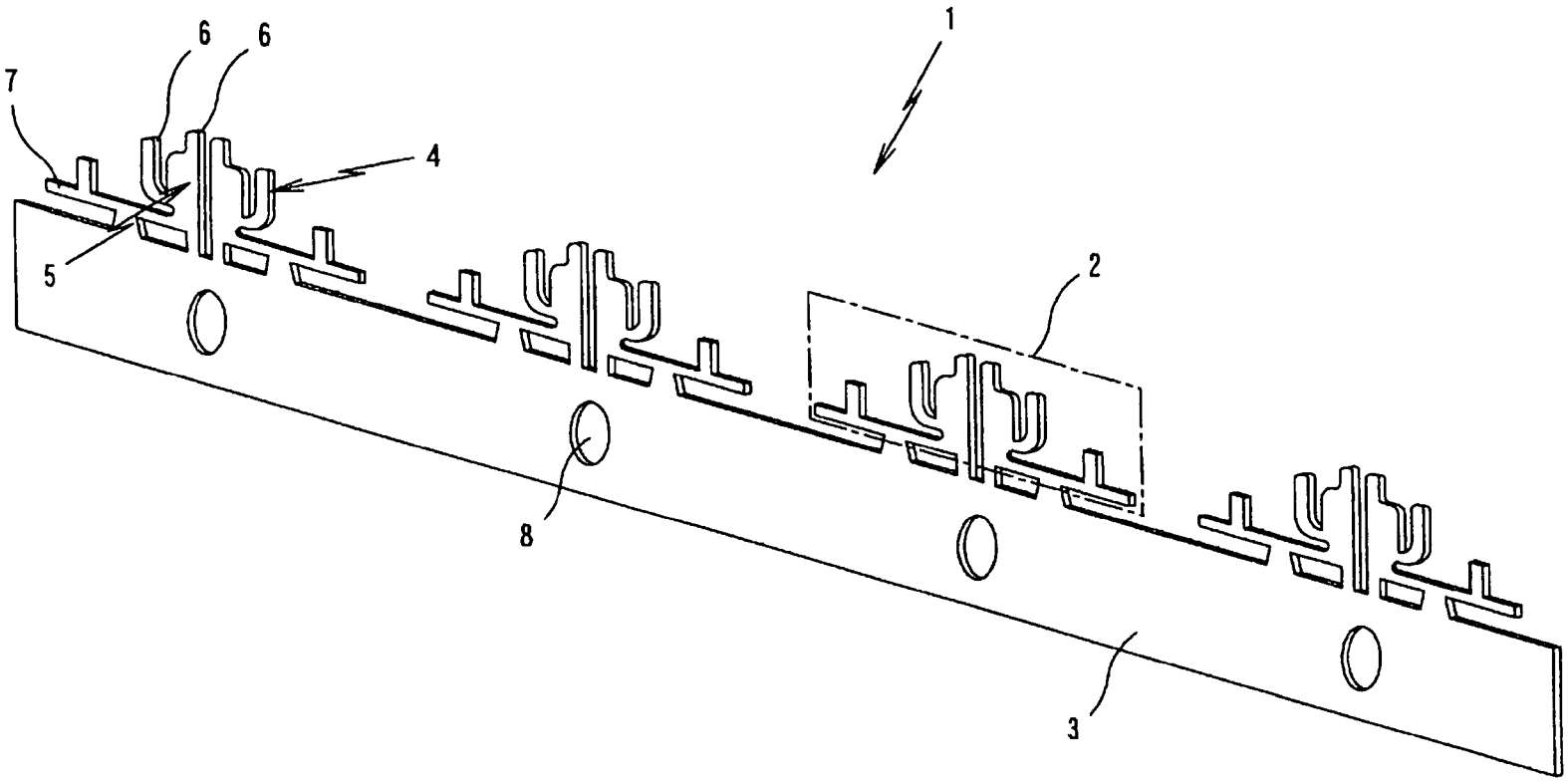
FIG. 1 shows a perspective view of the terminal stack, which is formed by connecting plural electronic connector terminals of the present invention to a common carrier.

1-terminal stack
2-terminal base material
3-carrier
4-lateral part
5-planar part
6-contact
7-leg part
8-hole
9-carrier bar
9*a*-end
10-supporting member
11-plating bath
12-anode
13-plating processing bath
14-recovery bath
15-bath control
16-terminal
17-Au plating layer
18-stacked bank Like reference numerals refer to like parts throughout the several views of the drawings.

DETAILED DESCRIPTION OF THE PREFERRED EMBODIMENT

The present invention will be explained in detail with reference to the accompanying drawings. However, the present invention is not to be limited to the particular embodiments described hereinafter. FIG. 1 shows a perspective view of a terminal stack 1. The terminal stack 1 comprises a plurality of terminal base materials 2 integrated on to a common carrier 3. The terminal base materials 2 are formed by punching a thin metal plate. The electronic connector terminal of the present invention is produced by subjecting the terminal stack 1 to Au plating thereafter cutting the carrier 3 to separate individual terminal base materials 2. Here, the term "terminal base material" 2 is defined as a terminal part formed by punching the thin plate prior to Au plating and does not include the carrier 3. Each terminal base material 2 comprises a lateral part 4 at least partially defined by the peripheral edge or cut surface formed when punching the thin plate. The terminal base material 2 also comprises planar parts 5 comprising the front and back surfaces of the punched piece. A contact 6 is disposed at one end of the lateral part 4 and the contact 6 is urged by pressure into engagement with a connection terminal of an electrical member (not shown). In the embodiment shown in FIG. 1, two contacts 6 are provided. In addition, a leg part 7, which is to be soldered to a substrate on which an electric connector (not shown) is placed, extends outwardly from the lateral part 4 of the terminal base material 2. The thin metal plate from which the terminal base material 2 is formed may include a copper alloy such as helium-copper and phosphor bronze or another electrically conductive metal such as aluminum with the thickness thereof between 0.1 mm and 0.3 mm. The shape of the punching press may be determined depending on the intended shape of the connection terminal.

Figure 2:
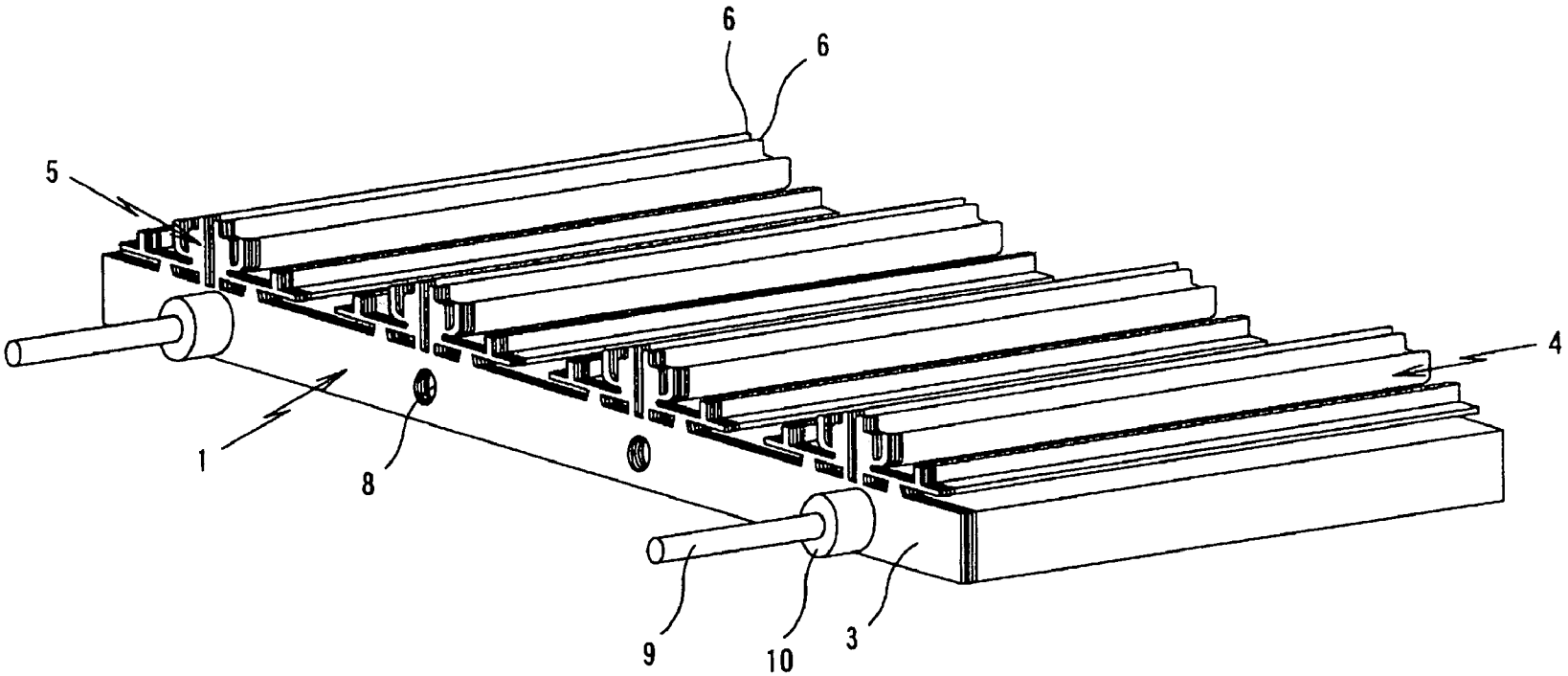
FIG. 2 shows a plurality of terminal stacks.

Carrier holes 8 are formed in the carrier 3 at predetermined spaced distances from one another as shown in FIGS. 1 and 2. The holes of are used to insert a carrier bar 9 of adequate flexibility therethrough. The electronic connector terminal of the present invention is generally produced by the steps of: plural terminal stacks 1 are disposed as shown in FIG. 2. Thereafter the carrier bars 9 are inserted to the carrier holes 8 so as not to separate the terminal stacks. The plating process described below is then performed. The Au or other high cost metal plating layer is formed on each of the plurality of the terminal base materials 2, and then the terminal stack 1 is cut apart from the carrier 3 to provide individual electronic connector terminals. Then each of the terminals is inserted to a connector housing (not shown). In the present invention, the high cost metal may include Pt, In, Pd, V, Ag, Ru, Sn, Co, Nb, Cr, Mo and Ni as well as Au which are produced in less amounts and have excellent electric, catalystic, and thermal properties. Hereafter, the present invention will be described using embodiments for applying the plating using Au as an example. However, a person skilled in the art may appreciate embodiments utilizing the other high cost metals or a combination thereof for plating.

In the present invention, a liner plating layer such as, but not limited to, a nickel plating layer may be disposed between the thin metal plate and the Au plating layer. The liner plating layer may be deposited to cover the terminal base material 2. The nickel liner plating may be used to provide a gloss effect and to harden the plating surface as well as to provide an anti-oxidation effect for the thin metal plate.

The electronic connector terminal of the present invention is covered substantially in its entirety by the Au plating layer. However, a thickness of the Au plating layer covering the planar part 5 is thinner than a thickness of the Au plating layer covering the peripheral or lateral part 4. The reason why the Au plating layer covering the planar part 5 is thinner is to prevent degradation of connector performance due to gradual oxidation even though the planar part 5 is placed in where less oxidation occurs. In comparison, the lateral part 4 including the contact 6 is used or placed in an atmosphere or environment where oxidation is more prevalent, such as due to electronic contact. Also, a lowering of the production cost would be a beneficial asset because of a reduced amount of Au plating deposited on the planar part 5, even though it has a greater surface area. It may be possible to reduce degradation of the connector performance by forming an insulation film on the planar part 5, however, that method would add the process step of masking the lateral part 4 which has already been applied with Au plating. As such, the insulation film would have to be deposited thereon necessitating additional materials and apparatus thereby increasing the production processes and failing to lower the production costs. The electronic connector terminal of the present invention makes it possible to provide the Au plating on the planar part 5 at the same time as the application of Au plating to the lateral part 4. However, the thickness of the Au plating on the planar part 5 is thinner than the thickness on of the lateral part 4. Therefore, the terminal will be provided inexpensively without the additional processes and materials.

In at least one embodiment of the present invention, when the liner plating layer is applied between the terminal base material 2 and the Au plating layer, it may be the same thickness as the Au plating layer. However, the liner plating layer may be formed such that the thickness thereof covering the planar part 5 is thinner than that on the lateral part 4 in order to produce the terminals less expensively.

Now, the method for forming the Au plating layer on the electronic conductive terminal, according to the present invention, will be described. FIG. 2 shows the situation in which the terminal stacks 1 are piled together and the carrier bars 9 are inserted through the carrier holes 8. The planar part 5 and the carrier 3 of the terminal in each of the terminal stacks 1 are substantially co-planar and only the exposed surfaces of the planar part 5 and carrier 3 of the outermost terminal stack 1 are freely exposed to the plating solution. As represented, the planar parts of the carrier 3 comprise the front and back surfaces of the carrier 3 and the lateral part of the carrier is defined as peripheral surfaces along the edges of the carrier 3. In the described embodiment in FIG. 2, the fixing member 10 is disposed in a predetermined position on the carrier bar 9 after inserting the carrier bar 9 into the carrier holes 8 of the terminal stacks 1 so as to prevent detachment of the terminal stacks, from the carrier bar 9.

Figure 3:
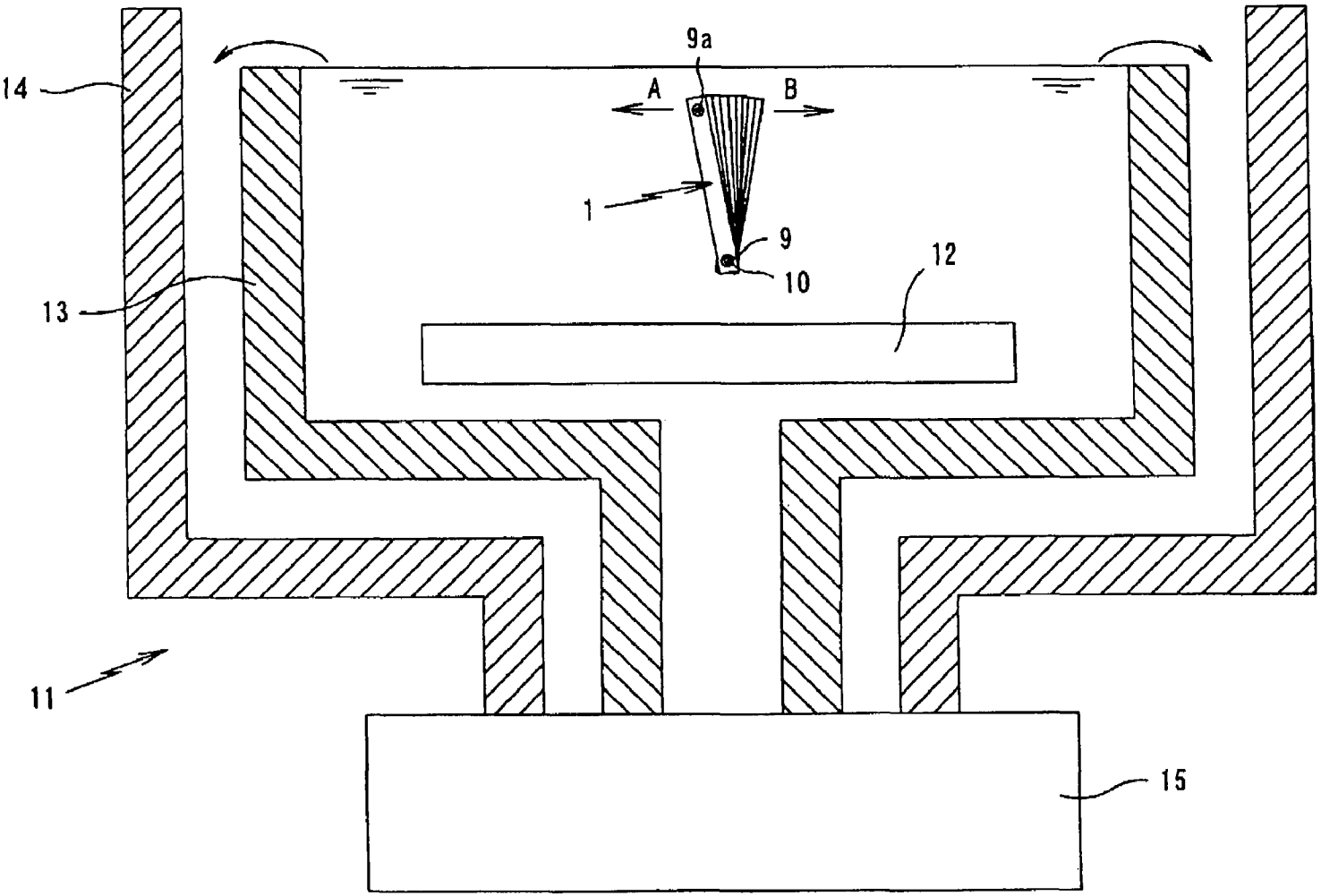
FIG. 3 shows an Au plating process where plural terminal stacks are dipped in a plating bath.

When the terminal stacks 1 supported by the supporting member 10 after insertion of the carrier bar 9 are dipped in the plating solution, the Au plating layers are prevented from being deposited on the adjacent planar parts 5 and the carrier 3 except for the outermost planar parts 5 and the outer exposed parts of the carrier 3. In the present invention, the inventor herein found that a thinner Au plating layer can be formed on the planar part 5 by dipping the terminal stacks 1 and reciprocally moving the terminal base materials 2 such that the planar parts of each of the terminal base materials 2 are exposed to the Au plating solution by allowing the plating solution to penetrate between the piled terminal stacks 1 of FIG. 2, as shown in FIG. 3.

The above method will be described in detail by referring FIG. 3. The method for applying Au plating may include in the present invention, by way of example, an electric plating method using an overflow-type plating bath. However, chemical plating methods may not be excluded from the intended scope of the present invention. The plating bath 11 comprises a plating-processing bath 13 in which an anode 12 is disposed in the bottom thereof, a recovery bath 14 is disposed around the plating-processing path 13 to recover plating solution which overflows from the plating-processing bath 13. A bath control 15 is operative to send the plating solution to the plating-processing bath 13 by sending the plating solution, under pressure, from the recovery bath 14 to the plating-processing bath 13. The plating bath 11 is designed to keep the plating solution at a predetermined level, while it overflows from the plating-processing bath 13.

Next, the plural plied terminal stacks 1 are connected to a cathode, and then are dipped into the plating solution in the plating bath 11. Thereafter, one end 9*a* of the carrier bar 9, which is inserted through the terminal stacks 1, is caused to make reciprocal or round trip movements in predetermined directions and at a predetermined frequency. For example, when the plural terminal stacks 1 are plied together, as shown in FIG. 2 using two carrier bars 9, one carrier bar may be fixed as at 9 in FIG. 3. In addition, one end 9*a* of another carrier bar is caused to reciprocate or make the round trip movements so that each of the terminal stacks 1 may also make the round trip movements. Accordingly and as shown in FIG. 3, when the one end 9*a* is moved in the direction of the arrow A, the plural terminal stacks 1 spread like a fan and a region of the planar parts of the terminal base materials and a region of the plane of the carriers are exposed to the plating solution. Further, when the end 9*a* is then made to reciprocate or move in the direction of the arrow B, which is in the inverse direction to the arrow A, the plural terminal stacks 1 spread like a fan again. Therefore, the plating solution on the surface of the planar part is extended as thin layers to penetrate towards the entire surface of the planar part. When these reciprocal movements are repeated, a thin Au plating layer on the entire planar part 5 may be deposited. The lateral parts 4 of the terminal base materials 2 are always exposed to the plating solution and therefore the thicker plating layer is formed on the peripheral or lateral parts 4 than on planar parts 5 and/or the exposed surfaces of the carrier 3.

In the present invention, the end opposite to the end 9*a* may be caused to make reciprocal or round trip movements in the opposite direction of the end 9*a* rather than moving only one end 9*a*. Alternatively, the another carrier bar may be caused to make the reciprocal or round trip movements simultaneously such that faces exposed to the plating solution are increased so as to form thin Au plating layer effectively on the entire planar parts.

In the present invention, plural terminal stacks 1 are formed by punching a thin metal plate, followed by arranging the plural terminal stacks 1 in a piled orientation of FIG. 2, further followed by inserting the carrier bar 9 into the holes 8. Next the plural terminal stacks 1 are supported on the carrier bar 9 by the fixing member 10 such that the terminal stacks 1 do not come off the carrier bar 9. Then the terminal stacks 1 are washed by acid including, for example, diluted HCL or diluted H2SO4 between 1 to 5 vol % and are next dipped into a Ni plating solution to deposit the liner Ni plating layer. In the steps of forming the acid-washing and liner Ni plating layer, the acid may be penetrated to the planar parts 5 of the terminal stacks 1 and the liner plating solution may also be penetrated to the planar parts 5 of the terminal stacks 1 by the above described reciprocal movements of the carrier bar 9. As such, the thickness of the liner plating layer covering the planar part 5 may be thinner than the thickness of the liner plating layer covering the peripheral or lateral part 4 since the lateral part 4 is continuously exposed to the plating solution.

Figure 4:
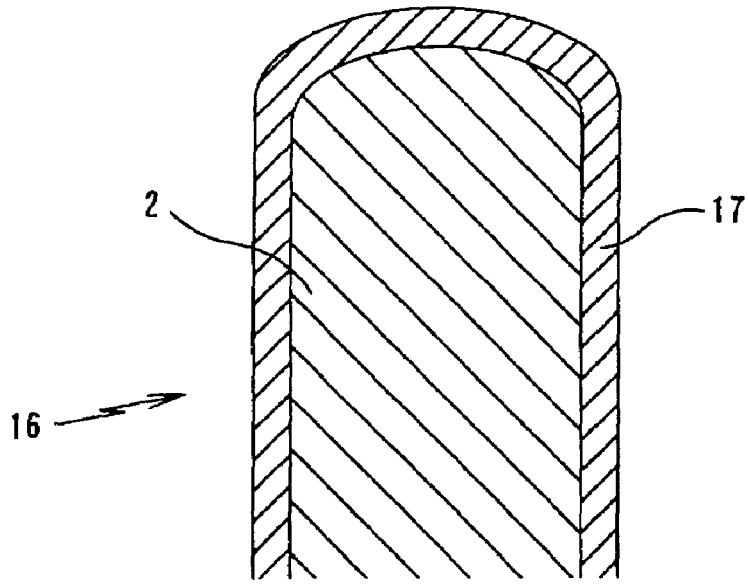
FIGS. 4*a* and 4*b* show cross sectional views of the electronic connector terminal of the present invention formed by punching a thin plate and then applying Au plating thereon.
Figure 4:
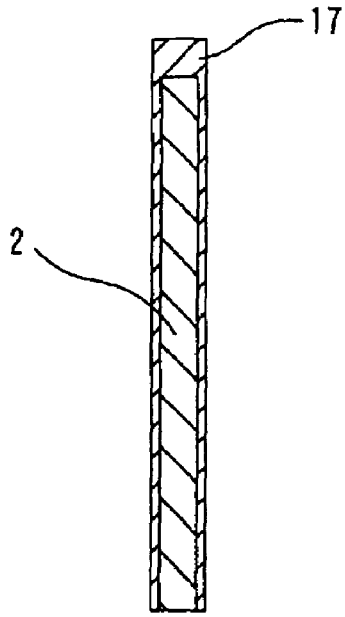

FIG. 4 shows the cross section of the terminal formed by punching the thin plate followed by the Au plating. Here, FIG. 4 shows a part of the terminal in an enlarged view. FIG. 4(*a*) shows the cross section of the terminal 16 viewed from the side facing the planar part 5 and FIG. 4(*b*) is the cross section of the terminal 16 viewed from the side facing to the lateral part 4. The terminal 16 shown in FIG. 4 comprises the Au plating layer 17 which is thicker on the peripheral edge or lateral part 4 and is thinner on the planar part 5 of the terminal base material 2. The ratio of the thickness of the Au plating layer 17 to the plating layer on the planar part may be from about 100 :1 to about 5:1 when considering the unevenness of the plating and preferably may range from 10:1 to 5:1 in the most preferred embodiments.

In the present invention, the liner-plating layer may be disposed between the terminal base material 2 and the Au plating layer 17. In such a case, a ratio of the thicknesses of liner plating layers covering the lateral part 4 and the planar part 5 may be also from about 100:1 to about 5:1 and may range from 10:1 to 5:1 in the most preferred embodiments.

The above described method comprises only the step of causing the carrier bar 9 to make reciprocal or round trip movements along predetermined directions at predetermined frequencies, and hence additional production steps and apparatuses for depositing insulation films are not required. In addition, the amounts of Au plating applied in accord with the present innovation may be largely reduced when compared with situations where Au plating is applied with the same thickness over all parts of the terminal stack 1.

Figure 5:
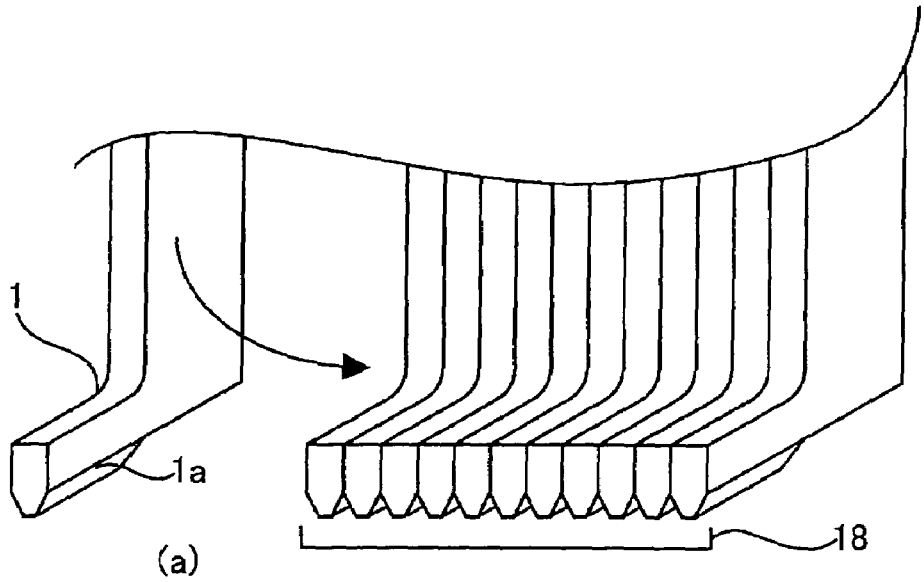
FIGS. 5*a* and 5B show different embodiments of a tab disposed at the end of the longitudinal limit of the carrier.
Figure 5:
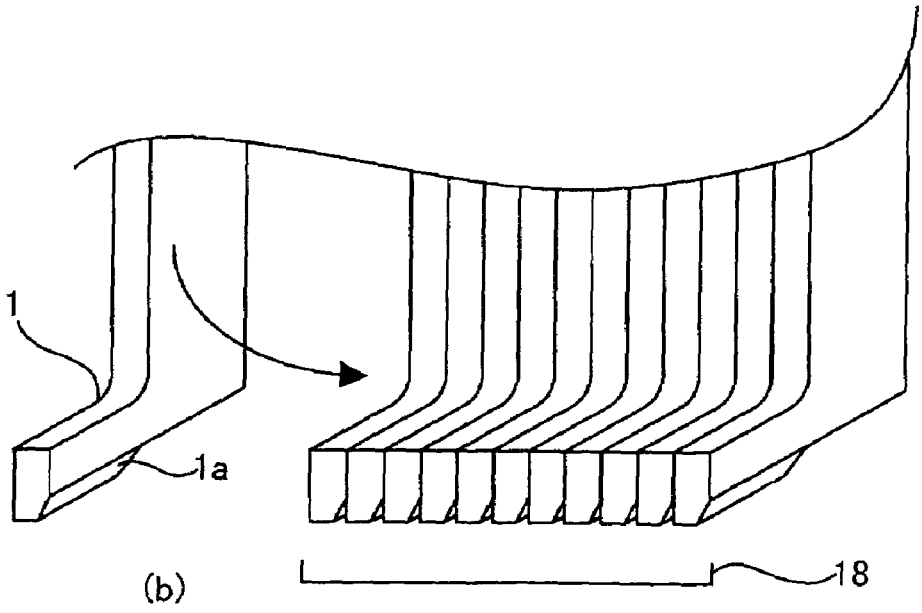

FIG. 5 shows a terminal stack 1 used in the present production method. In FIG. 5(*a*), a first embodiment of the terminal stack 1 is shown and FIG. 5(*b*) shows a second embodiment of the terminal stack 1. First, referring to FIG. 5(*a*), the tab 1*a* is formed at the end of the terminal stack 1. The tab 1*a* comprises a substantially triangle or trapezoid shape defined by surfaces extending from the edges of the lateral sides and slanted or inclined with respect to the thickness of the terminal stack 1 while extending for a predetermined length along to the end of the terminal stack 1. The terminal stack 1 shown in FIG. 5(*a*) is juxtaposed to form the stack bank 18 and then the stack bank 18 is subjected to plating according to the present invention. The tab 1*a* shown in FIG. 5(*a*) prevents the stack bank 18 from binding together such as by surface tension of the plating solution when the stack bank 18 is subjected to the reciprocal or round trip movement in the plating processing bath. More particularly, when the tab 1*a* is moved to cause the reciprocal or round trip movements, a separating force to part the terminal stacks 1 is created so that the plating solution can smoothly flow into the spaces between the terminal stacks. Excellent plating may be applied on the lateral sides to enhance production yields.

Referring to FIG. 5(*b*), the terminal stack 1 having the tab 1*a* with a different shape from that of FIG. 5(*a*) is depicted. The tab 1*a* of the terminal stack 1 of FIG. 5(*b*) includes a protrusion with a substantially trapezoid shape. As such, one lateral face is cut with respect to the thickness of the terminal stack 1 and extends for an adequate length along the edge of the terminal stack 1. As described in FIG. 5(*a*), the tab 1*a* of FIG. 5(*b*) creates a separating force between the terminal stacks 1 when the stack bank 18 is caused to make reciprocal, round trip movements so that the production yield may be improved. Here, the terminal stack 1 may be formed by known pressing or punching moldings and a tab 1*a* may be formed at one or both of the ends longitudinally opposite ends.

The electronic connector terminal according to the present invention can be produced easily without requiring the additional production process such as formation of the insulation film on the planar part in order to protect the degradation of the connector performance. The electronic connector terminal of the present invention is also produced at lower costs due to reduced amount of high cost metals necessary for plating and further is able to maintain sufficient contact pressure even when the terminals have a narrow width.

Hereinabove, the present invention has been explained based on the particular embodiments depicted in the drawings, however, a person skilled in the art may appreciate that exclusion of the elements, omissions, other embodiments, and additions may be possible in accordance with the teachings of the above description. The true scope of the present invention will be determined only by claims attached herewith.

Since many modifications, variations and changes in detail can be made to the described preferred embodiments of the present invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An electronic connector terminal comprising a terminal base material formed by punching a metal thin plate and a high cost metal plating layer covering said terminal base material, said high cost metal being selected from the group consisting of Pt, In., Pd, V, Ag, Ru, Sn, Co, Nb, Cr, Mo, Au and Ni and any combination thereof, said terminal base material further comprising a lateral part having at least one contact and defined as a cut surface of said thin plate through said punching and a planar part defined by front and back surfaces of a punched-out piece from said thin plate, wherein a thickness of a high cost metal plating layer covering said planar part is thinner than a thickness of a high cost metal plating layer covering said lateral part.

2. The electronic connector terminal of claim 1, wherein a ratio of said thickness of said high cost metal plating layer covering said lateral part and said thickness of said high cost metal plating layer covering said planar part is to be from about 100:1 to 5:1.

3. The electronic connector terminal of claim 1, wherein said electronic connector terminal comprises a liner plating layer formed between said terminal base material and said high cost metal plating layer so as to cover at least a portion of said terminal base material.

4. The electronic connector terminal of claim 3, wherein a thickness of a liner plating layer covering said planar part is thinner than a thickness of a liner plating layer covering said lateral part.

5. The electronic connector terminal of claim 3, wherein a ratio of said thickness of said liner plating layer covering said lateral part and said thickness of said liner plating layer covering said planar part is from about 100:1 to 5:1.

6. A method for plating an electric connector terminal including a plating layer of a high cost metal, said method comprising the steps of: connecting a stack bank to at least one carrier bar, said stack bank comprising of a plurality of terminal stacks juxtaposed in adjacent relation to each other, dipping the stack bank in a plating solution including the high cost metal, and plating the terminal stacks by electric plating while moving the stack bank along round trip movements in said plating solution at predetermined cycles and predetermined directions so as to deposit plating layers of different thicknesses on a lateral part and a planar part of the terminal stacks.

7. The method of claim 6, wherein said high cost metal is selected from the group consisting of Pt, In, Pd, V, Ag, Ru, Sn, Co, Nb, Cr, Mo, Au and Ni and any combination.

8. The method of claim 6, wherein the terminal stacks comprise a plurality of terminal bases and the step of making round trip movements further comprises the step of moving the carrier bar through reciprocal movements at predetermined cycles and in predetermined directions.

9. A plated terminal stack comprising:

a plurality of terminal bases;

an elongated carrier connected to each of said plurality of terminal bases, said carrier including a plurality of openings through which at least one carrier bar is inserted;

at least one tab including a slant plane with respect to a thickness of said carrier, said tab being disposed at an end defining a longitudinal limit of said carrier, and said tab being further disposed and structured to create a separating force sufficient to part said terminal bases during reciprocal movement thereof within a plating bath.

10. The terminal stack of claim 9 comprising a tab disposed at both ends of said carrier.

11. The terminal stack of claim 9, wherein said tab has a cross section comprising a generally triangle or trapezoid shape.

* * * * *